United States Patent [19]

Bernstein et al.

[11] 4,314,336

[45] Feb. 2, 1982

[54] ELECTRONIC CARD GAME SIMULATOR

[75] Inventors: William L. Bernstein, Los Angeles; Robert M. Del Principe, Hawthorne, both of Calif.

[73] Assignee: Mattel, Inc., Hawthorne, Calif.

[21] Appl. No.: 108,880

[22] Filed: Dec. 31, 1979

[51] Int. Cl.[3] ..... G06F 15/44

[52] U.S. Cl. ..... 364/411; 273/292; 340/323 R

[58] Field of Search ..... 364/410, 411, 412; 340/323 R; 273/85 G, 292

[56] References Cited

U.S. PATENT DOCUMENTS

| | | | |
|---|---|---|---|
| 3,796,433 | 3/1974 | Fraley et al. | 273/292 X |
| 3,876,208 | 4/1975 | Wachtler et al. | 273/292 X |
| 4,130,871 | 12/1978 | Olsen et al. | 364/411 |
| 4,173,342 | 11/1979 | De Corlieu-Ferran | 340/323 R X |
| 4,193,600 | 3/1980 | Armstrong et al. | 340/323 R X |

*Primary Examiner*—Jerry Smith

*Attorney, Agent, or Firm*—Reagin & King

[57] ABSTRACT

A portable electronic card game simulator having a housing mounting a display and input keys and containing electronic data processing circuitry organized to provide, at various skill levels, the automatic play of a hand of Gin Rummy, Go Draw, or Thirty-Three, in opposition to an operator. The simulator deals a hand to the operator and to the electronic opponent. The play of the electronic opponent is controlled by circuitry to simulate the play of a human in accordance with the rules of the game. The display includes indicia representing each of the cards in a single deck of cards. These indicia are used to display either the operator's hand, the opponent's hand, or the score of the game.

16 Claims, 10 Drawing Figures

ELECTRONIC CARD GAME SIMULATOR

BACKGROUND OF THE INVENTION

This invention relates to games and, more particularly, to electronic games for simulating the play of card games.

People have apparently been involved in the playing of games since the beginning of recorded history. The interest of most such games is provided by the excitement of chance and the competitive qualities of playing against another person. Of course, this has required that more than one person be involved in each such game. Recently, various improvements in electronic circuitry, especially those related to semiconductors and computer circuitry, have led to the reduction of circuit size and have allowed various electronic circuits to be constructed which simulate well known games. In these electronic games, a person plays against the electronic machine thereby eliminating the necessity for other players. Many of these electronic games are quite expensive. In the usual case, the electronic game must be connected to a television set which provides the display upon which the game is presented. Such limitations of the prior art have made these electronic games useful, in general, only in a fixed situation, for example, in the living room of one's home.

Recently, a number of portable electronic games have been devised by which a person may play a particular simulated sports game such as football or basketball. These portable electronic games have their own built in displays and are much less expensive, in general than those which must be connected to a television set. They are also much more useful since they may be used in many more physical locations. However, the portable electronic games are usually unable to provide more than a single game for play by an operator because of the limited nature of their circuitry and the general requirement that they be powered by battery. In general, the portable electronic games have heretofore been relatively unsophisticated as contrasted to those which are associated with television sets.

It is, consequently, an object of this invention to provide a new and improved electronic card simulating game.

It is another object of this invention to provide a new and improved electronic game capable of simulating a variety of card games.

It is another object of this invention to provide a new and improved electronic game capable of simulating the play of the game of Gin Rummy.

It is another object of this invention to provide an electronic Gin Rummy game operable at different skill levels.

It is an additional object of this invention to provide a new and improved electronic circuit capable of simulating the playing of the card game, Go Draw.

It is another object of this invention to provide a new and improved electronic game capable of simulating the play of the card games, Gin Rummy, Go Draw, and Thirty Three, through operator controlled inputs.

SUMMARY OF THE INVENTION

The foregoing and other objects of the invention are accomplished by a portable electronic card game simulator which has an exterior housing mounting a display upon which the various cards, hands, and results are presented; mounting input keys for controlling the operation of the game; and containing electronic data processing circuitry within the housing organized to provide automatic play of Gin Rummy, Go Draw, and Thirty Three against a human operator. In each of the simulated games, a hand is dealt to the human operator and to the electronic opponent; and the play of the electronic opponent is controlled to simulate the play of the human which the electronic opponent has replaced in accordance with the rules of the particular game. In particular embodiments, this computer opponent control includes circuitry for determining the presence of runs, of cards of the same value, and other features of the particular games. In each of the simulated games, the electronic circuitry also has arrangements for checking compliance with the rules of the game and for controlling the display to show the game being played, the cards held in the operator's hand, the status of the game, and the scores of the operator and his electronic opponent.

Other objects, features and advantages of the invention will become apparent by reference to the specification taken in conjunction with the drawings in which like elements are referred to by like reference designations throughout the several views.

DESCRIPTION OF THE PREFERRED EMBODIMENT

Figure 1:
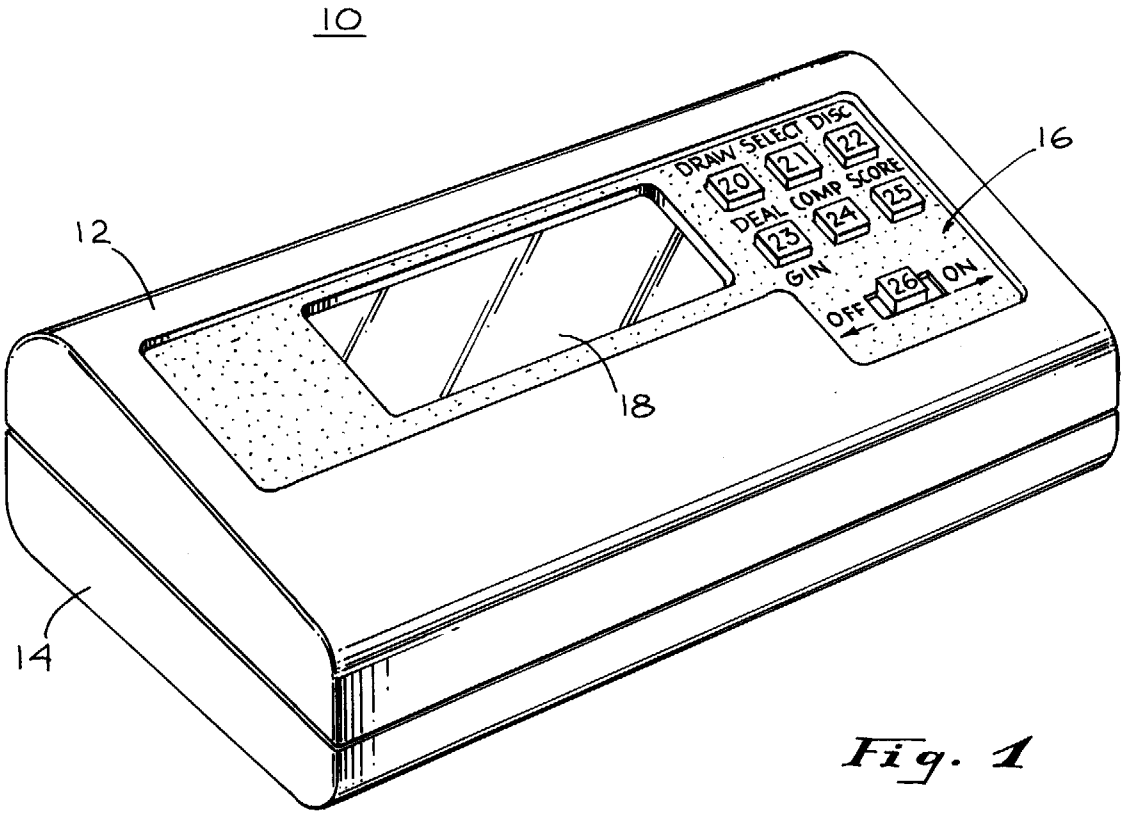
FIG. 1 is a perspective view of the exterior of a housing containing an electronic card game simulator constructed in accordance with the invention.

Referring now to the drawings and, more particularly, to FIG. 1, there is shown a perspective view of an electronic card game simulator 10 constructed in accordance with this invention. The simulator 10 includes an upper housing 12 and a lower housing 14 each of which may be constructed of a moldable plastic material. The housings 12 and 14 may be joined together in a manner conventional to the housing of electronic circuitry to form a hollow interior for the containment of electronic components. The upper housing 12 mounts a control panel 16 which includes a display 18 and input keys 20 through 26. The input key 20 is designated "draw"; the input key 21, "select"; the input key 22, "discard"; the input key 23, "deal" and "gin"; the input key 24, "comp"; the input key 25, "score"; and the input key 26, "off-on". On the bottom of lower housing 14, but not shown in FIG. 1, is a door for providing access for insertion of conventional batteries, such as a nine volt transistor battery, to operate the circuitry contained within the housing halves 12 and 14 of the simulator 10.

Figure 2:
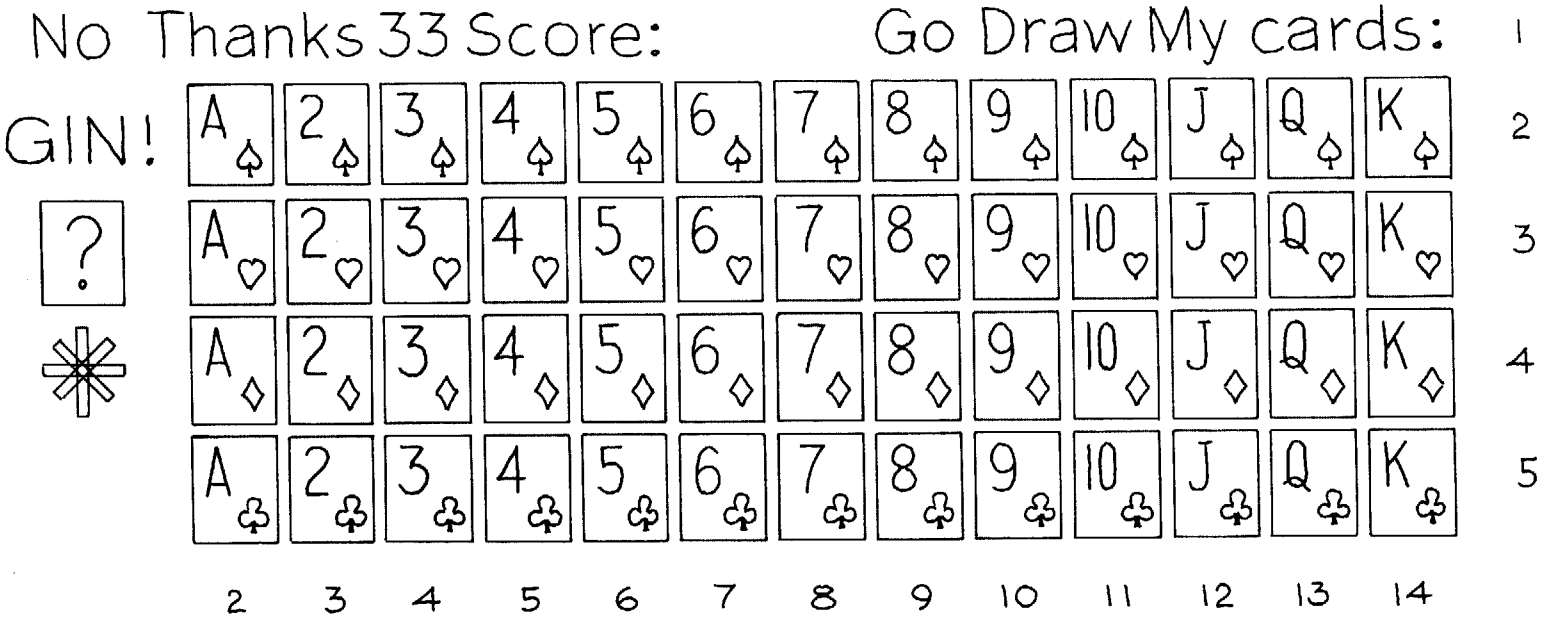
FIG. 2 is a diagram illustrating an arrangement by which information is presented on the display of the housing shown in FIG. 1 in a preferred embodiment.

Referring now to FIG. 2, there is shown a diagram of the information presented in a preferred embodiment by the display 18 of the simulator 10. As will be noted, the display 18 has five rows designated 1 through 5 at the right-hand edge of the drawing and fourteen columns designated 1 through 14 at the bottom of the drawing. Row 1 contains the words: "No", "Thanks", "33", "Score:", "Go Draw", and "My Cards:". Row 2 contains the word "Gin!" and the thirteen spades from ace through king. Row 3 has the notation "?" followed by the thirteen hearts in the sequence ace through king. Row 4 has an "*" followed by the thirteen diamonds in the sequence ace though king, and Row 5 contains the thirteen clubs in the order ace through king.

Any of these indications may be selected and displayed singly or with other indications in a manner well known to the prior electronic art by designating a particular row and column at which such indication lies. The particular indications displayed at each step of the operation of the simulator 10 will be explained in the following description of the operation of the simulator 10.

Figure 3:
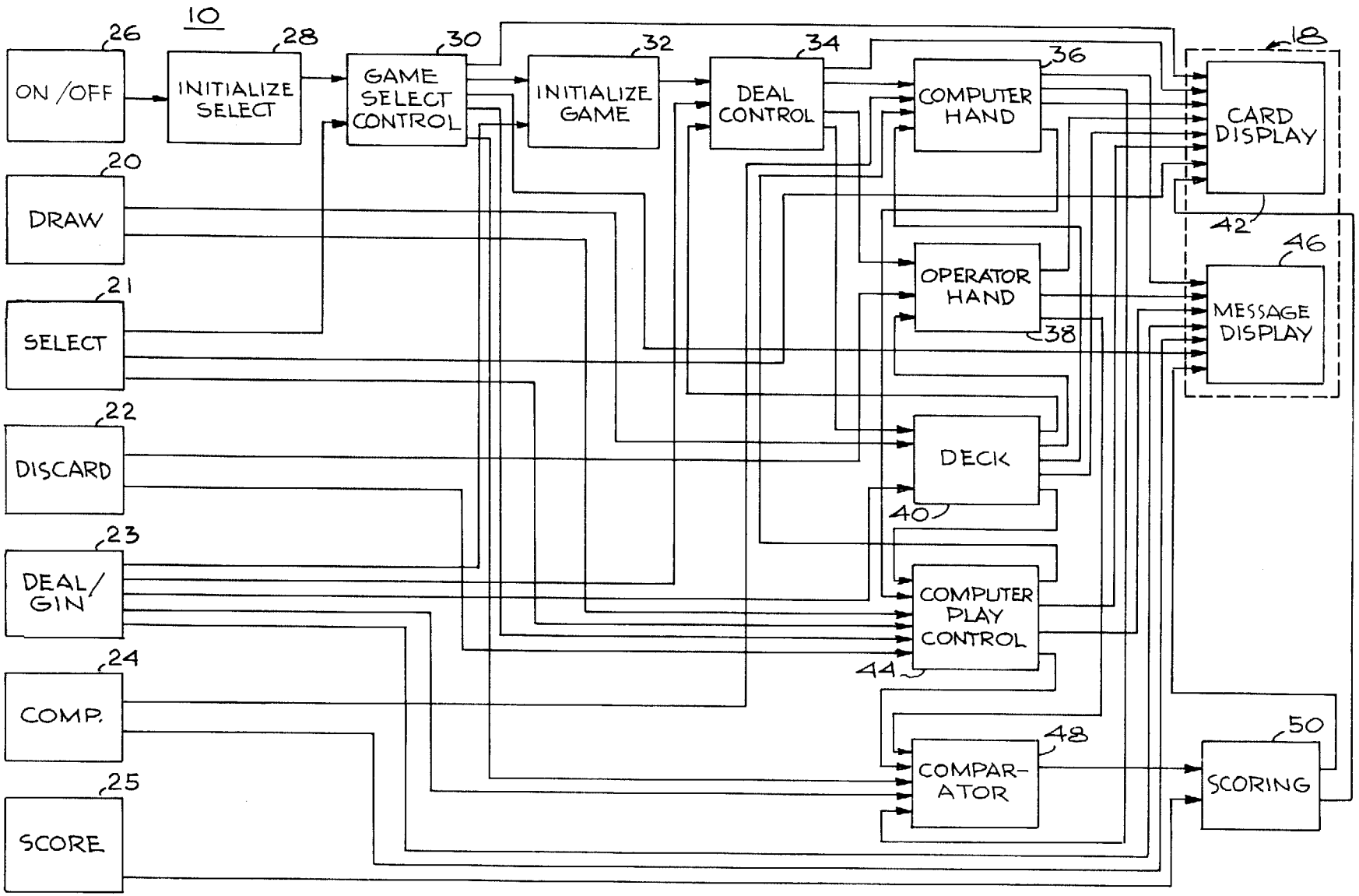
FIG. 3 is a block diagram of a circuit arrangement of the card game simulator of the invention for playing Gin Rummy.

Referring now to FIG. 3, there is shown a block diagram of the circuitry of a simulator 10 constructed in accordance with the invention. At the extreme left of FIG. 3 are positioned each of the input keys, (or switches) 20 through 25 described in FIG. 1. The energization of the simulator 10 by means of the on-off switch 26 operates an initialize/select circuit 28. The initialize/select circuit 28 is connected to furnish an input signal to a game select circuit 30 which provides an output signal for initializing each of the individual games which may be played by the simulator 10. The initialize game circuit 32 provides an input signal to a deal control circuit 34 which controls the method of dealing cards to each of a computer hand 36 and a human operator hand 38. The deal control circuit 34 provides output signals directly to the computer hand 36, to the operator hand 38, and to circuitry representing a deck 40. The deal control circuit 34 is also connected to provide input signals to a card display 42 which is a part of the display 18. The computer hand 36 and the operator hand 38 also provide signals to the card display 42 so that after the deal and at various times during the play of each game, the player hand, the up card, and the computer hand may be displayed. The deck 40 is also connected to provide an output signal to both the computer hand 36 and the operator hand 38 so that cards may be drawn from the deck 40 during the play of the game.

The other input keys 20 through 25, which provide means by which the operator may play his hand, are variously connected to the circuitry of the simulator 10 to allow that result. For example, the draw key 20 is used in the play of the game in order to draw a card from the deck. The draw key 20 is therefore connected to provide an input signal to the deck 40 and a second input signal to a computer play control circuit 44 which controls the play of the hand of the computer during each game. The computer play control circuit 44 provides direct output signal to control the computer hand 36 and also provides output signals to the card display 42 and a message display 46 which is also a part of the display 18 illustrated in FIG. 1. The message display 46 also receives input signals from the computer hand 36, from the operator hand 38, and from the game select control circuit 30. The connection to the game select control circuit 30 allows the display 18 to signal the operator as to the particular game which has been selected. The game select control circuit 30 is also connected to the card display 42 since various cards are utilized in illustrating the particular game which is being played.

The select input key 21 is used for a number of purposes. First, it is used to select the particular game to be played and for that purpose is connected to the game select control circuit 30. In addition, the select input key 21 is also used to help indicate which card is to be discarded in particular games and for that purpose is connected to both the card display 42 and to the computer game play control circuit 44.

The discard input key 22 is used with select input key 21 to select cards to be discarded and is, therefore, connected to the operator hand 38 and to the computer game play control circuit 44.

The deal/gin input key 23 is used initially to cause cards to be dealt to both the computer hand 36 and the operator hand 38. Consequently, it is connected to the initialize game circuit 32 and therethrough to the deal control circuit 34 by which the computer hand 36 and the operator hand 38 are dealt selected cards. The deal/gin input key 23 is also connected to the message display circuit 46 of the display 18 and to a comparator circuit 48 which is used to determine whether the rules of the game have been complied with in each of the games playable by the simulator 10. For example, the comparator circuit 48 receives input signals from the computer hand 36 and the operator hand 38 so that when gin rummy is being played it may review the hands held by each to determine whether in fact a gin is present in the particular hand. The comparator circuit 48 provides output signals to a scoring circuit 50 which operates the card display 42 and the message display 46 to control the display of the appropriate scoring messages. It should be noted that the deal/gin input key 23 is used by the operator to signal that he believes that his hand contains a gin and thereby to initiate the operation of the comparator circuit 48. It should also be noted that the deck circuit 40 receives an input signal from deal/gin input 23 and provides output signals to the card display 42 and the computer play control circuit 44. For certain purposes the deck 40 also provides an output for the deal control circuit 34.

The computer cards input key 24 is connected to the computer hand 36 and the message display circuit 46 so that at the end of the game the cards held by the computer hand 36 may be displayed on the display 18.

The score input key 25 is connected to the scoring circuit 50 to provide an indication by means of the display 18 of the score in the game.

Figure 4:
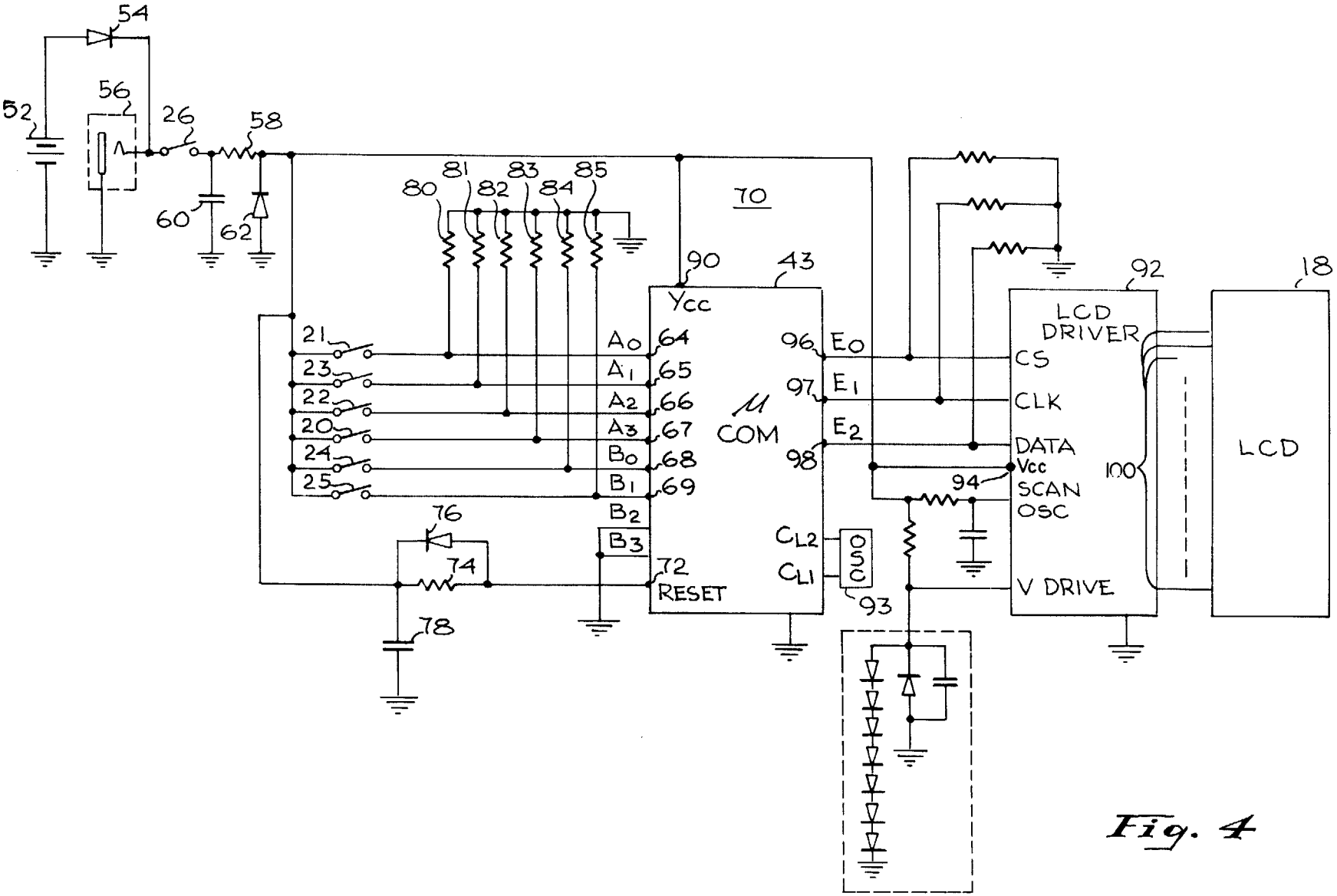
FIG. 4 is a schematic diagram of circuitry utilized in a preferred embodiment of the invention.

Referring now to FIG. 4, there is shown a schematic circuit diagram of a circuit which may be utilized to implement the block diagram illustrated in FIG. 3. As may be seen in FIG. 4, a battery 52, which may be a standard 9-volt transistor battery used to operate various electronic games, supplies power through a diode 54 to the off-on switch 26. An adaptor jack 56 is also provided to allow the circuit to receive power from a conventional transformer (not shown) which may be connected to a house power supply. The switch 26 supplies the power to the remainder of the circuitry via a resistor 58 which is grounded at one side by a capacitor 60 and at the other by a diode 62. The resistor 58 is connected to each of the switches 20 through 25 and thereby to a set of input terminals 64 through 69, respectively, of a circuit 70. The resistor 58 is also connected to a reset terminal 72 of the circuit 70 by means of a resistor 74 connected in parallel with a diode 76. The reset terminal 72 is grounded through a capacitor 78.

When any one of the switches 20 through 25 is closed, it provides a current to ground through the selected one of a number of resistors 80 through 85 thereby causing a voltage drop across the selected one of the resistors 80 through 85 which is applied to the particular input terminals 64 through 69 of the circuit 70. Operating voltage is also applied from the battery 52 via the resistor 58 to the circuuit 70 at a terminal 90 and to a conventional liquid crystal display driver circuit 92 at a terminal 94. An oscillator 93 generates clock pulses for circuit 70. The circuit 70 provides output signals at terminals 96, 97 and 98 for operating the L.C.D. driver circuit 92. The L.C.D. driver circuit 92 provides a number of outputs generally indicated as 100 for operating the L.C.D. circuits of the message display 18.

As will be understood by those skilled in the computer art, the circuit 70 may be implemented in any of a number of different ways. However, as with many prior art electronic game circuits, the preferred embodiment of the invention utilizes a integrated circuit which provides a miniature digital electronic computer (a microprocessor) preferrably constructed on a single chip. Such integrated circuits are well known and include the input, output, memory, logic, and control circuitry of a special purpose digital computer in miniature form. In general, such circuits have both random access memory (RAM memory) and read-only memory (ROM memory). The ROM memory has connections formed by the masking operations in the construction of the basic circuitry of the digital computer itself to provide a completely wired circuit, which includes the program for controlling the operation of the microprocessor. Such an arrangement is often described as a dedicated memory circuit. The RAM memory of the circuit is utilized for storage of the various bits of information during the operation of the circuitry.

Various circuits made on a single chip of material or on multiple chips are offered by a number of manufacturers and are well known to the prior art. A preferred embodiment of the invention utilizes a MicroCom-43 single chip micro computer manufactured by NEC Microcomputers, Inc. This curcuit is a 4-bit parallel central processing unit which has a 2,000 by 8-bit program ROM memory, a 96 by 4 bit data RAM memory, thirty-five input/output channels, a programmable interval timer, interrupt handling circuits, a clock generator, and control circuits. The details of the MicroCom-43 are contained in the user's manuel therefore published by NEC Microcomputers, Inc., 173 Worcester St., Wellesley, Mass.

The general operation of the simulator 10 will now be explained with reference to FIG. 3. When power is initially applied to the circuit through the operation of off-on switch 26, the simulator 10 initializes all of its memories by operation of the initialize select circuit 28. At this point, the simulator 10 is in a state to provide play of one of four distinct games which will be referred to hereinafter as Gin 1, Gin 2, Go Draw, and 33. In the preferred embodiment, Gin 2 is the first game offered. The card display 42 and the message display 46 indicate which of the four games is ready to be played by the following four indications: "Gin" and the ace of clubs is lit to indicate Gin 1, "Gin" and the deuce of clubs is lit to indicate Gin 2, "Go Draw" is lit to indicate the game Go Draw, and "33" is lit to indicate the game 33. Thus, "Gin" and the deuce of clubs is lit initially.

Depressing the select key 21 with power on operates the game select control circuit 30 to select a different game to be played; with each depression, a different game is selected. The selection of any particular game by means of the game select control circuit 30 causes the initialize game circuit 32 to set the circuitry to a state such that the particular program circuitry for the deal control circuit 34, the computer game play control circuit 44, and the computer circuit 48 to be actuated to perform in accordance with the rules of the particular game selected.

Presuming that Gin 1 or Gin 2 have been selected, the game proceeds as follows. The operator depresses the deal/gin input key 23. The deal control circuit 34 deals ten cards to the computer hand 36 and ten cards to the operator hand 38. The cards dealt to the operator hand 38 are dealt at random while the cards dealt to the computer hand 36 are, in a preferred embodiment, selected in the following manner. The deal control circuit 34 causes a first card to be dealt to the computer hand 36 and then causes three other cards to be dealt either to make a complete run or four of a kind when associated with the first card dealt. In the preferred embodiment, it is determined on a first random basis whether a run or cards of the same value are to be dealt and whether the run (or the cards of the same value) proceeds up or down from the card initially dealt. Thus, referring to FIG. 2, if a five of hearts were initially dealt the computer might decide at random to complete a run to the right by selecting the six, seven and eight of hearts, or a run to the left by selecting the two, three and four of hearts. Alternatively, the computer might decide to select cards of the same value, namely, the fives of diamonds, clubs, and spades. The deal control circuit 34 next deals a second card at random to the computer hand 36 and in like manner completes a run or adds cards of the same value, in this instance adding only two cards, however. Finally, the deal control circuit 34 deals a third card and completes a run of three or adds two additional cards of the same value.

Thus, the computer hand 36 is dealt a perfect gin hand. In Gin 1, the deal control circuit 34 then causes the computer hand 36 to discard at random three of the cards in its perfect hand and deals at random three more cards to the computer hand 36. In Gin 2, on the other hand, the deal control circuit 34 causes the computer hand 36 to discard only two cards from its perfect hand and deals at random two more cards to the computer hand 36. In both cases, the computer hand 36 signals the discarded cards to the computer game play control 44 and these cards are retained in memory.

At this point, the deal control circuit 34 deals and signals to the card display circuit 42 a card which is considered to be the turned up discard. This is accomplished by causing one of the cards in the display shown in FIG. 2 to flash on and off. At the same time, the deal control circuit 34 causes the card display 42 to display those cards which are contained in the operator hand 38 which have been dealt at random from a random card generator (not shown). Play proceeds from this point with the human operator taking the first turn. As in the card game of Gin Rummy, the operator may choose the discard or draw a card from the deck. The operator chooses the flashing card, (the discard) by depressing the select input key 21. This causes another card in the operator hand 38 to begin flashing and indicates that the player decides to keep the face up discard. The operator continues depressing the select button 21, and each of the cards displayed on the card display 42 in his hand flashes in turn. When the card the operator wishes to discard flashes, the operator ceases pressing the select button 21 and presses the discard input key 22, which causes the flashing card to disappear from the card display 42 and the operator hand. Alternatively, the operator may wish to draw from the deck 40. If so, the operator presses the draw input key 20, causing the flashing face up discard to disappear from the card display 42 and the deck 40 to deal a new card which appears as a new flashing card on display 42. The operator may decide to discard this flashing card by pressing the discard input 22, or he may retain this card and operate the select input 21 to step through the other cards in his hand until he reaches the card he wishes to discard. At this point, the operator discards by pressing the discard input key 22.

It is conceivable that the operator will after the discard have only runs and cards of the same value in his hand, ie., a perfect Gin Rummy hand. If so, the operator then presses the deal/gin input key 23, which causes the comparator circuit 48 to read the output of the operator hand 38 to determine whether a perfect gin hand is present. If such a hand is present, the comparator circuit 48 signals the scoring circuit 50 to display the word "Gin!" on the message display 46 of the display 18 and to award one point to the operator.

If the comparator circuit 48, on the other hand, determines that the operator hand 38 does not contain a perfect gin hand, the circuit 48 causes the scoring circuit 50 to operate the message display 46 to indicate "No Gin" and to award the computer opponent one point.

Presuming that the operator does not have gin upon drawing his first card, the operator presses the discard input key 22 and the computer opponent begins it turn. At this point, the flashing card discarded by the player disappears and a new flashing card appears. This means that the computer has played and discarded a new card. If the "*" lights up on the message display 46, the new flashing discard came from the computer hand 36. If the word "Thanks" lights up, the computer took the operator's discard. If "No thanks" lights up, the computer drew a card from the top of the deck and discarded from his hand. Thus, the following combinations may occur upon the computer's turn:

"No Thanks"—means that the computer refused the operator's discard and drew a card; the computer then refused this card and it is the new face up card.

"No Thanks *"—means that the computer refused the operator's discard and drew a card which it accepted and discarded a card from the computer hand 36.

"No Thanks * GIN!"—means that the computer refused the operator discard and drew a card which it accepted, but upon discarding it has a gin.

"Thanks *"—means that the computer accepted the up card discarded by the operator and discarded a card from its hand.

"Thanks * GIN!"—means that the computer accepted the operator's up card and upon discarding a card from its hand has gin.

Presuming that the computer does not have gin at this point, the play then returns to the operator and alternates between the operator and the computer until one of the two obtains gin. During this entire operation, the play of the computer hand 36 is controlled by the computer play control 44. In controlling the play of the game by the computer hand 36, computer game play control 44 looks for the cards which it originally discarded when dealt its first perfect gin rummy hand. These cards are retained in memory and when selected from the discard or drawn from the deck 40 by the computer hand 36 are compared and found desirable by the computer game play control circuit 44. Consequently, while the operator plays an actual hand of Gin Rummy with cards being dealt to him on a random basis, the computer plays a game in which it hunts for particular pre-selected gin hands by hunting for cards previously discarded. This action by the computer game play control circuit 44 allows a relatively small amount of memory to be used to simulate the play of Gin Rummy by the computer hand 36. As will be noted in the description of FIG. 5 which follows, the computer play control circuit 44 and the comparator circuit 48 do check to determine whether a gin occurs with each new card selection by the computer hand 36 from either the deck 40 or the discard even though the card drawn is not one of the original discards for which the circuit 44 searches. Obviously, this method which discards three cards for one version of Gin Rummy (Gin 1) and only two cards for a second version of Gin Rummy (Gin 2) provides two different skill levels of play for the computer hand 36 against which the human operator strives. The utilization of such a simulated game play by the computer game play control 44 requires only a minimum amount of memory and thereby allows additional circuitry to be available by which the games of Go Draw and Thirty Three may be included within the same simulator 10.

Once the operator hand 38 of the computer hand 36 has been found to have Gin Rummy, the machine displays the operator's ending hand. Each player receives one point for a winning hand. The operator may obtain the score at that point in the play by pressing the score input 25. The operator may also determine the computer hand against which he was playing at that point by pressing the discard input key 22. If he presses the discard input key 22 again, he will see the operator's hand again. To deal a second hand of Gin Rummy, the deal/gin input key 23 is pressed causing the deal control circuit 34 to deal a second hand. The game then proceeds as described above.

When the operator selects the game of Thirty Three by depressing the select input switch 21 until the game select control 30 causes the "33" indication to be displayed on the message display 46, the game select control 30 causes the appropriate program to be selected from memory by the initialize game circuit 32 and provided to the computer game play control circuit 44, the deal control circuit 34, and comparator circuit 48 so that they function in accordance with the rules of the game Thirty Three. In the game Thirty Three, when the deal/gin key 23 is operated the deal control 34 deals two cards at random both to the operator hand 38 and to the computer opponent's hand 36 and turns one card face up. The operator hand 38 and the face up card are indicated by the card display 42 of the display 18 at this point with the face up card flashing. The object of the game is to select a hand whose total value is equal to thirty three, the ace through ten being valued at one through ten points, respectively, and face cards being valued at ten points each. The rules of the game provide that a player may take the single face up card and discard one card from its hand or may draw two cards from the deck 40 and discard a single card from its hand.

In proceeding with the play, the operator goes first and may select the face up card by pressing the select input key 21 to cause another card in its hand to flash. Alternatively, the operator may depress the draw input key 20 causing the deck 40 to add two new cards to the operator hand 38, the flashing face up card to disappear, and a card in the operator hand to flash. Upon deciding which card to discard, the operator presses the discard input key 22. This causes the flashing card to disappear from the screen and the computer opponent to operate under control of the computer game play control 44 in accordance with the rules explained above. However, in this case the computer game play control circuit 44 selects cards for the computer hand 36 on the following basis. First, the computer includes the face up card, the operator's discard, in its hand and checks to determine whether the cards in its hand total 33. This is accomplished by adding the total value of the cards in his hand and subtracting 33 to determine a remainder. The computer game play control circuit 44 looks through the cards in its hand to determine if it has a card equal to the remainder which is may discard to give it exactly 33. If it does, it discards that card and causes the comparator circuit 48 to generate the indication of "33" on the message display 46 by means of the scoring circuit 50. It it does not have such a card, it looks for the next highest card to discard. If the computer hand 36, which checked by the computer game play circuit 44, has a total of less than 33 points, it discards its lowest value card, while if it has more than 43 points it discards its highest valued card.

Play continues as explained above until one or the other of the operator hand 38 or the computer hand 36 has a perfect Thirty Three hand after discard. If the computer has such a hand, this is automatically indicated by the comparator circuit 48 and displayed via the scoring circuit 50 on the message display 46. If the operator has a perfect Thirty Three hand, he presses the deal/gin input key 23 causing the comparator circuit 48 to review the operator hand 38 to determine whether thirty three points are present. This is accomplished by the comparator circuit 48 by counting the value of cards in the player hand and subtracting thirty-three to see if a zero remainder is present. The scoring indications for the game Thirty Three are as in the two versions of Gin Rummy. If the operator or the computer opponent has thirty three points, that player is awarded one point. On the other hand, if the operator incorrectly indicates thirty three points, the comparator circuit 48 determines that such a hand is not present; and the computer hand 36 is awarded one point. It should be noted that the scoring is indicated by the display 18 by lighting various of the cards on the card display 42. For example, in a preferred embodiment, each club lit designates one point for the player while each diamond lit designates one point for the computer. Thus, if the score is operator three-computer two, the display will light the ace, two, and three of clubs and the ace and two of diamonds.

If the operator by depression of the select input key 21 causes the game select control 30 to select Go Draw as the game to be played, the initialize game circuit 32 and the game select control circuit 30 provide the data to the deal control circuit 34, the computer game play control circuit 44, and the comparator circuit 48 to undertake a mode of play by which of the rules of the game Go Draw are implemented. When this occurs, the message display 46 displays the words "Go Draw." In the game Go Draw, when the deal/key 23 is depressed, the deal control circuit 34 causes the computer hand 36 and the operator hand 38 each to be dealt ten cards at random. The operator hand 38 will be displayed by the card display 42 with one of the cards therein flashing. In the game of Go Draw, the object is to obtain four of a kind and each four of a kind is scored as one point for the player obtaining it. A player obtains his cards after the deal has been completed by first asking the other player whether he has cards of the same value as a card held in the asking player's hand. If the player asked does not have such a card he so indicates and the message display 46 displays "Go Draw" whereupon the player selects from the deck 40.

Thus, after the deal, the operator hand 38 is displayed with one card flashing. The operator may ask the computer opponent for an identical card, e.g., fives to match a five, by depressing the draw input key 20. Alternatively, the operator may select another card in his hand by depressing the select input 21 and sequentially causing the cards of his hand to flash on and off until he reaches the card for which he wishes to ask the computer opponent. This he does by depressing key 20. If the computer opponent has the card requested in the computer hand 36, all such cards will be given to the operator hand 38 and displayed in the operator hand 38 by the card display 42.

If the operator hand 38 at that point has four of a kind of the requested card, the cards will disappear from the card display 42 as the comparator circuit 48 makes the four of a kind determination, and the scoring circuit 50 will cause one point to be added to the operator's total score. If the computer does not have the card requested by the operator, the message display 46 will indicate "Go Draw" and a new card is dealt by the deck 40. The operator then ends his turn by pressing the discard key 22 which causes the computer turn to begin.

In Go Draw, the computer play control circuit 44 is programmed to decide which card to ask for from the operator hand 38 and flashing that card. The decision as to which card to request is accomplished by first asking for cards which the computer game play control 44 knows have already been taken from the computer hand 36 by the operator and have not been withdrawn from the deck by comparator circuit 48 as four of a kind. If no such cards exist in the operator hand 38, the computer play control circuit 44 next looks for three cards of a kind in the computer hand 36 and asks for such cards. If three of a kind do not exist, it looks for two cards of a kind and asks for such cards. If none exists, the computer play control circuit 44 randomly selects cards from the computer hand 36 to ask for.

When the computer asks for a particular card, the "?" and the "*" are displayed by the message display 46 and a card which is in the computer's hand 36 flashes on the card display 42. If the operator has a card of this value, he must depress the discard input key 22 and the card disappears from his hand. If the operator does not have such a card, he depresses the draw input key 20 which causes the message display 46 to indicate "Go Draw," and the computer selects a card from the deck 40.

The game continues until a player runs out of cards. At this point, the score input 25 may be depressed to display the score of the operator and of the computer opponent.

Figure 5A:
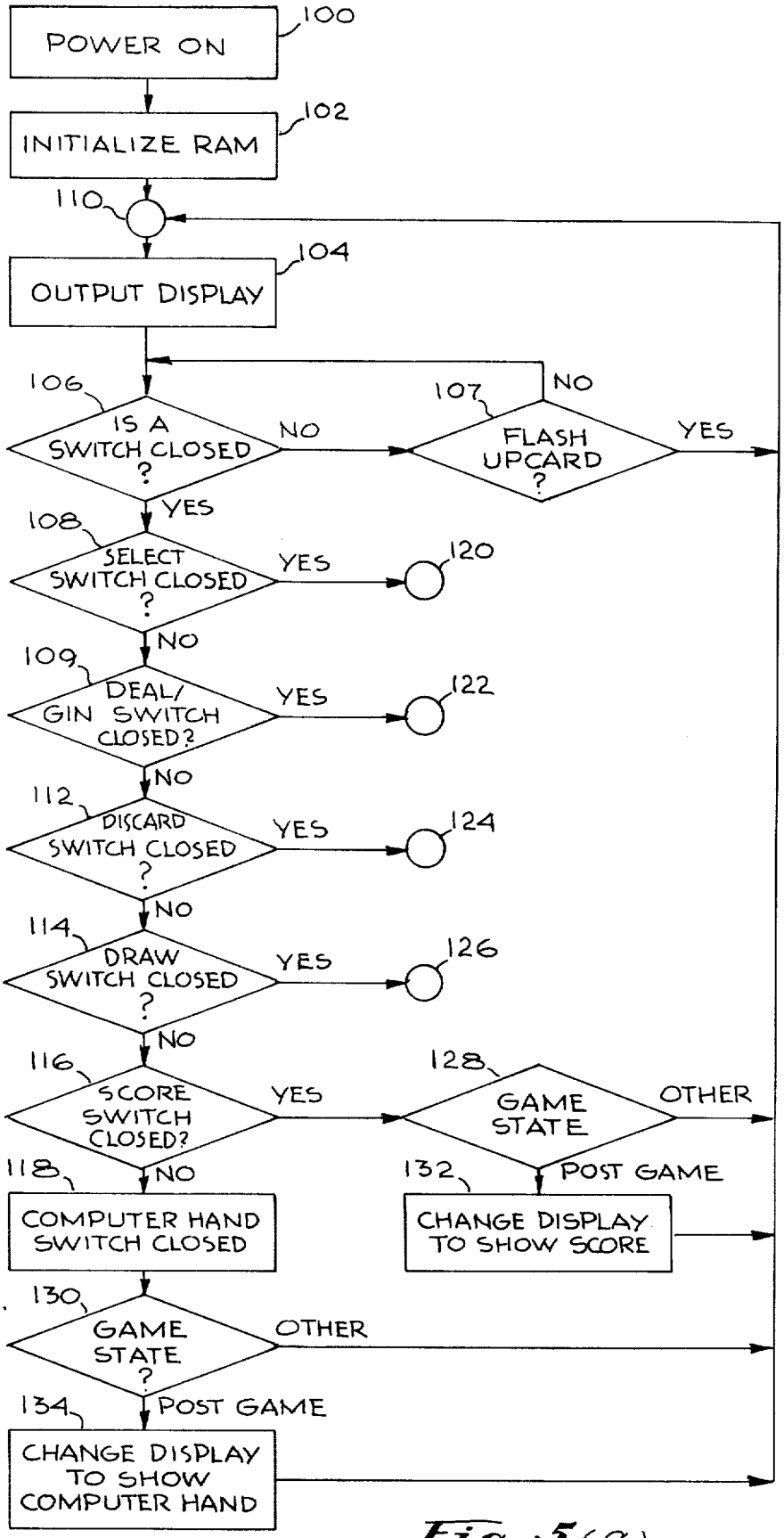
FIGS. 5(*a*)–5(*e*)-2 together comprise a flow chart illustrating the sequence of operations performed by the circuitry of the electronic card game simulator of this invention in playing Gin Rummy, Thirty Three, and Go Draw.
Figure 5:
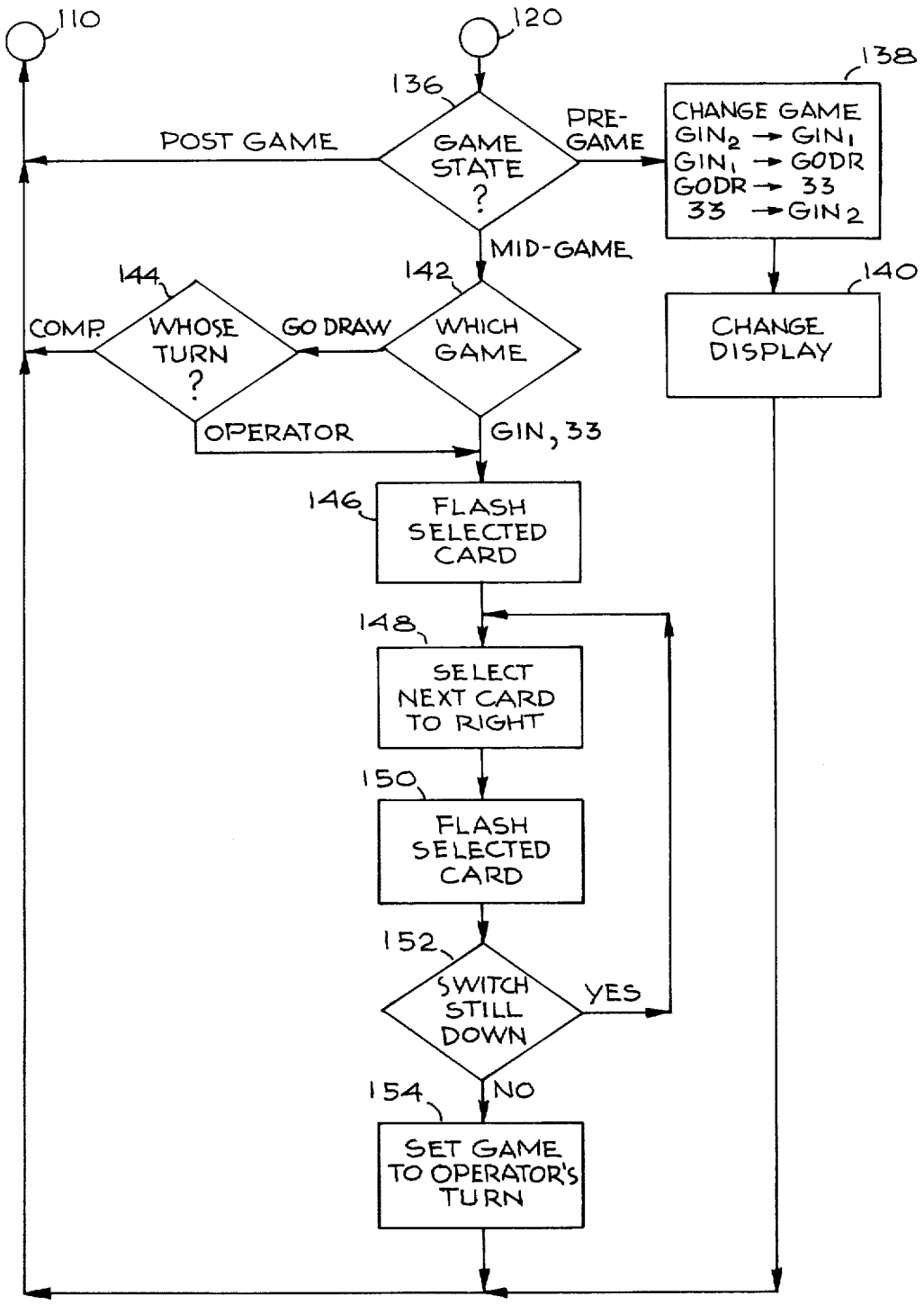
Figure 5C:
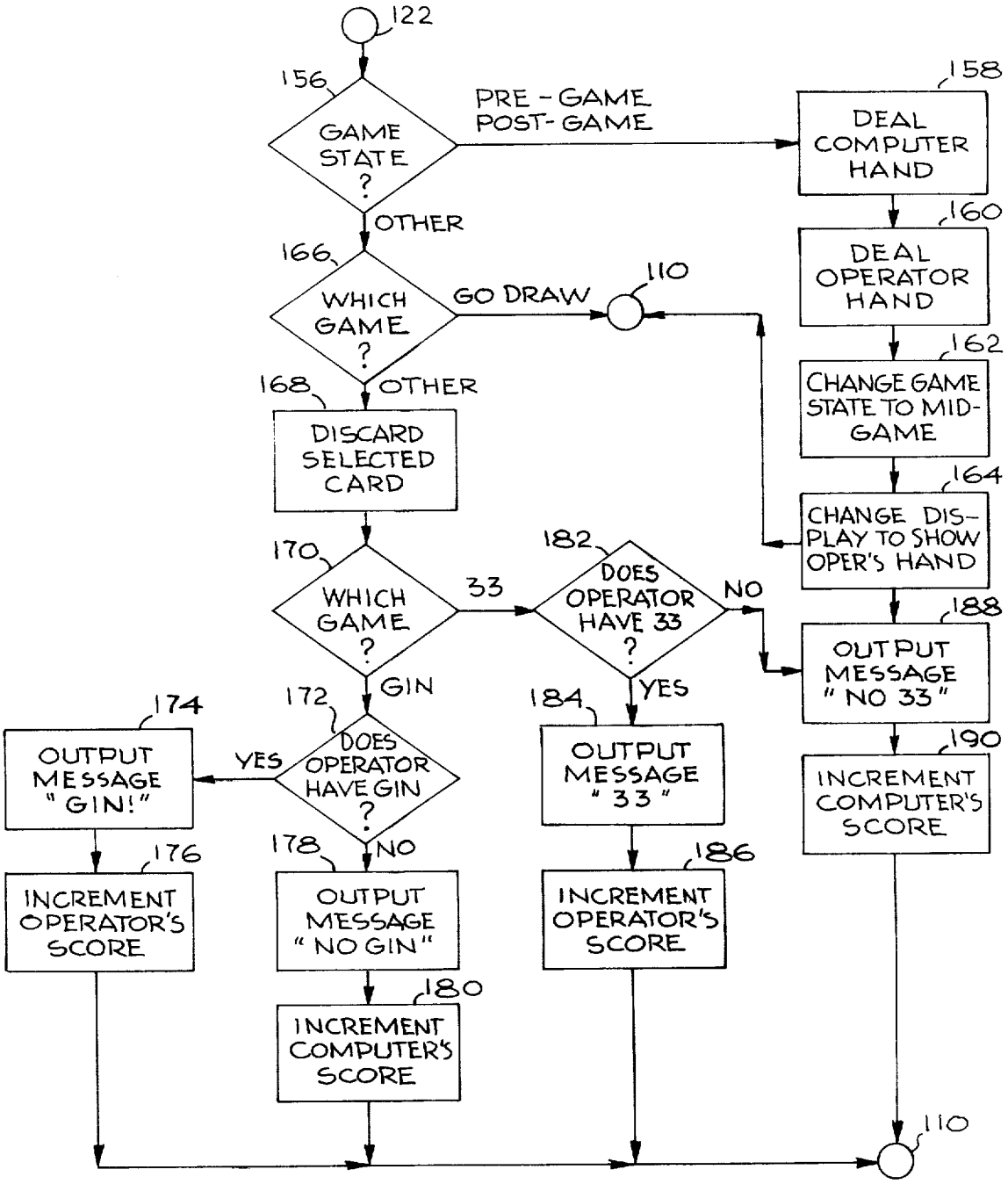
Figure 5D:
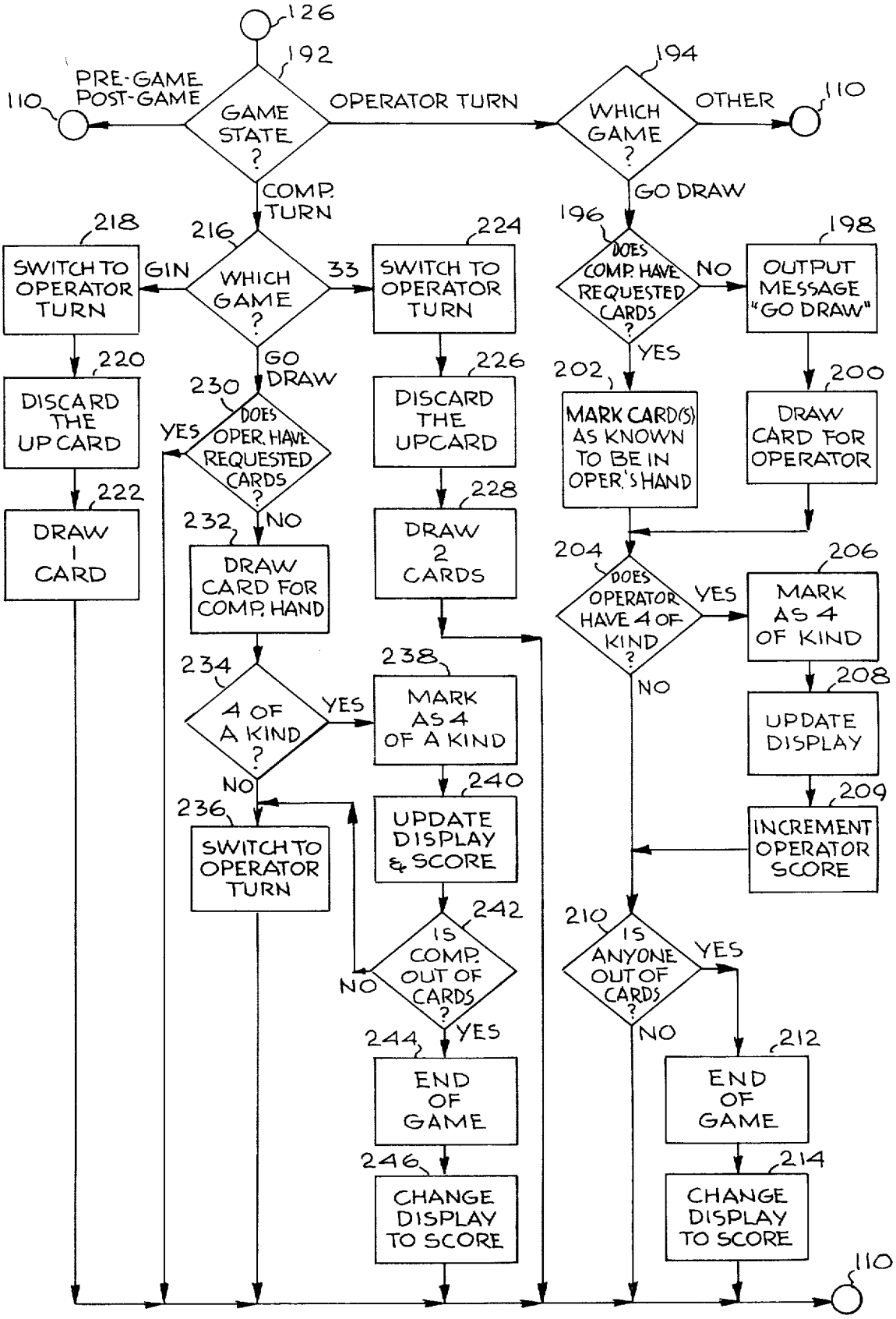
Figures 1, 5E:
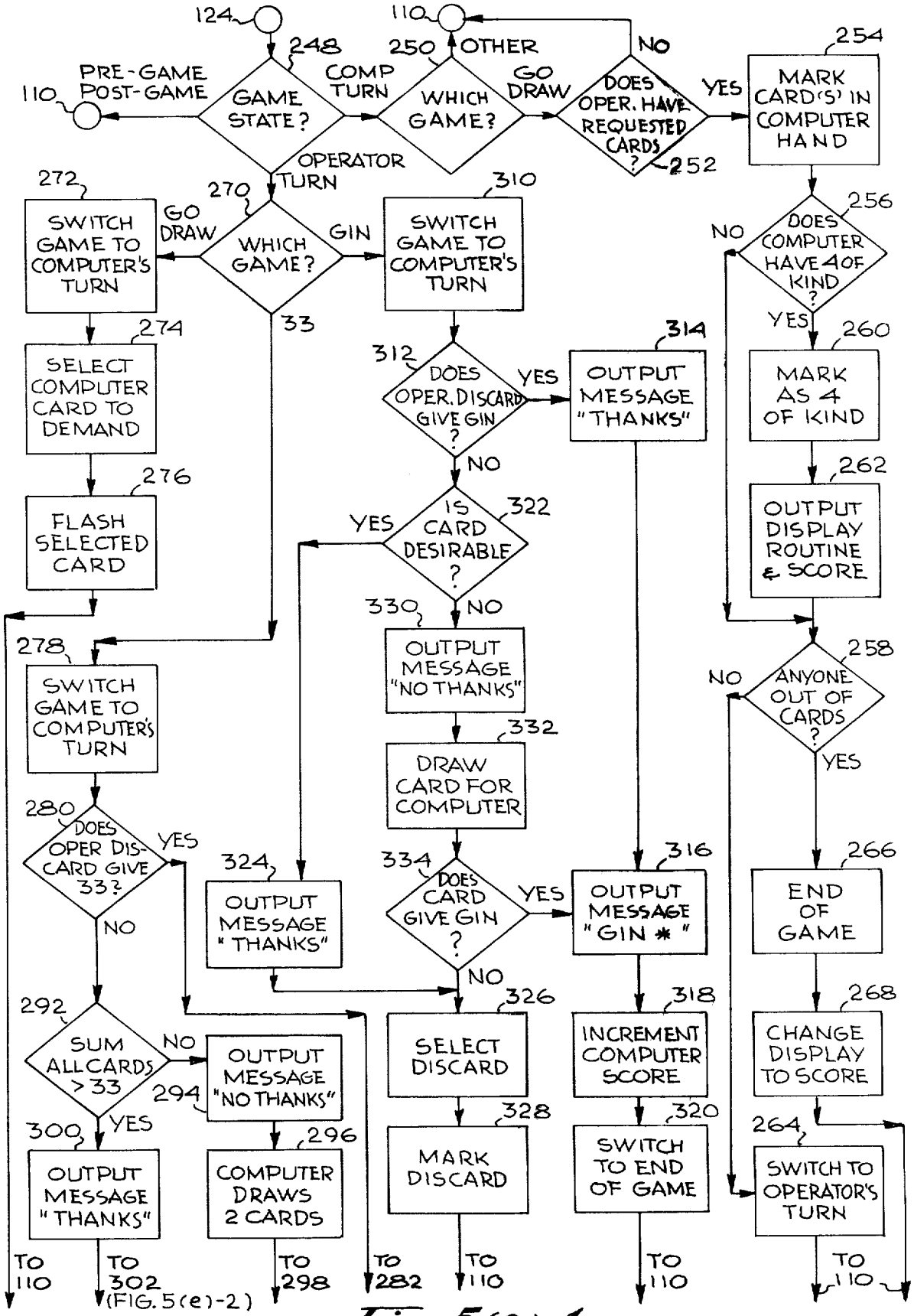
Figures 2, 5E:
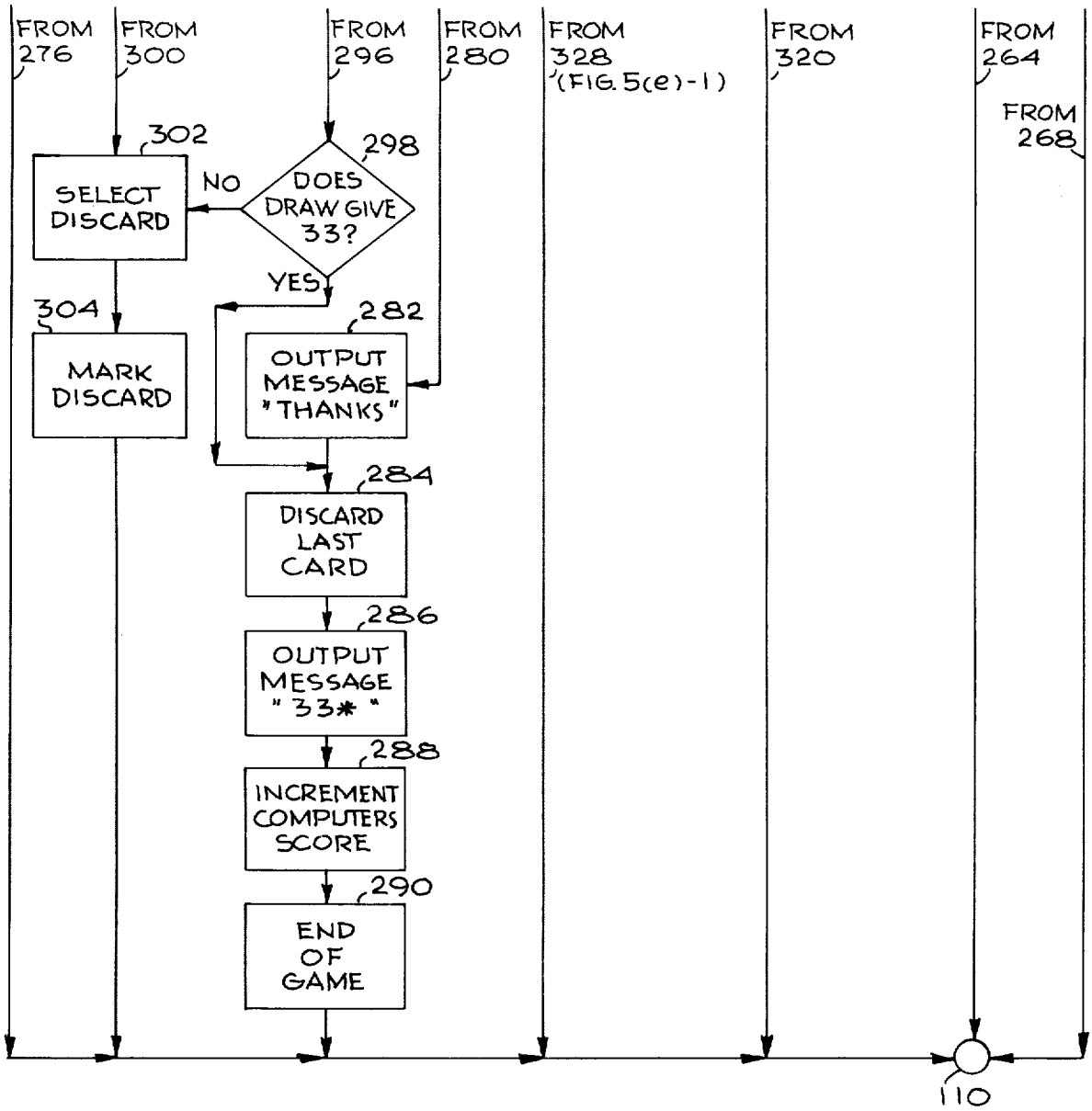

Referring now to FIGS. 5(*a*) through 5(*e*), there is disclosed a flow chart for operation of the preferred embodiment of the simulator 10 described herein. FIG. 5(*a*) shows those steps through which the program of the simulator 10 passes in operation in response to the operation of the input switches 20 through 26. When the power is turned on at step 100 by the closure of the off-on switch 26, the random access memory is initialized at step 102 by setting it to zero. This causes the display 18 to provide an output at step 104 in accordance with the particular game to which it is first set when the power is turned on. In the preferred embodiment, the selected game is Gin 2. The program next inquires at step 106 whether one of the input switches 20 through 25 is closed and, if none is closed, inquires at step 107 whether the face up card should be flashed. This is determined in accordance with the rules of the particular game initially in the simulator 10 when the power is applied; in Gin 2 no card is flashing at this time. In the recirculation of the program, if the face up card should be flashed, the sequence of the program is returned to the junction step 110 of the flow chart. If it should not be flashed in accordance with the rule of the game, then the flow of the program is returned to step 106. If at step 106 it is determined that a switch is closed, the program functions to determine whether the select switch 21 has been closed at step 108, the deal/gin switch 23 has been closed at step 109, the discard switch 22 has been closed at step 112, the draw switch 20 has been closed at step 114, the score switch 25 has been closed at step 116, or the computer hand switch 24 has been closed at step 118. If any one of these switches has been closed the program is diverted to junction points 120, 122, 124, and 126 and to steps 128 or 130, respectively. If at any step inquiring as to the condition of an input key (switch) it is determined that the particular key has not been operated, then the program steps to inquire as to the condition of the next key in order. For example, in FIG. 5(*a*), if none of the select, deal, discard, or draw switches have been depressed and the score input switch 25 is depressed, the program inquires as to the game state at step 128 and, if it is other than post-game, returns to step 110 because score cannot be indicated except after a hand of a game. If the game state is after the completion of the play of a hand, then the program steps to step 132 where the display 18 is caused to indicate the score of the game. After step 132, the program returns to step 110 to determine the condition of the various switches.

If on the other hand, none of the select, deal, discard, draw, or score input switches have been depressed, the program proceeds to step 118 where it presumes that the computer hand switch 24 has been depressed and inquires at step 30 what the state of the game is. If the state of the game is other than after the completion of a hand, the program returns to step 110 because the computer hand cannot be displayed except after the completion of a hand in any of the games. If the hand has been completed, then the program proceeds to step 134 at which display 18 is changed to show the final computer hand in the play of that hand. Thereafter, the program moves to step 110 to recirculate through the switch determination steps.

FIG. 5(*b*) illustrates the steps of the program when it is determined that the select switch has been depressed and the program moves through the junction step 120. At this point, the program proceeds to the decision step 136 to determine the game state. If the game state is before the hand has been played, then depression of the select key 21 means that the game should be changed to another game. In such a case, the program proceeds to step 138 where the game is changed in the preferred embodiment so that if Gin 2 was previously being played, Gin 1 is now selected for play; if Gin 1 was previously being played, Go Draw is selected for play; if Go Draw was previously being played, Thirty Three is selected for play; and if Thirty Three was previously being played, Gin 2 is selected for play. In such a case, the program proceeds to step 140 to change the display to indicate the particular game being played and recirculates to junction step 110.

If, on the other hand, the state of the game is mid-game at which the select key 21 is used to select cards, the program proceeds to step 142 at which a determination is made as to which game is being played. If Go Draw is being played, the program circulates to step 144 where it is determined whose turn it is. If it is the computer's turn, the program recirculates to junction step 110 because the depression of key 21 has no meaning. If it is the player's turn, the program moves to step 146 (as it does if either Gin 1, Gin 2, or Thirty Three is being played at step 142). At this point, the selected card is flashed on and the further depression of the select key 21 means that the next card in sequence should be selected and flashed. This is accomplished at step 148 where the next card to the right is selected and at step 150 where it is flashed on and off. The program then moves to step 152 to determine whether the select input switch 21 is still depressed. If it is, the program recirculates to step 148 to cause the selection of the next card in order and its flashing on the display 18. If the select input switch 21 is not still depressed, then the program proceeds to step 154 where the game is set to the operator's turn and returned to junction step 110.

If in FIG. 5(*a*) the program has found at step 109 that the deal/gin input switch 23 has been depressed, then the program proceeds via the junction 122 to step 156 (see FIG. 5(*c*)) in which the game state is determined. The deal/gin key 23 is used to deal the hand in each game and to signal gin or thirty three in the operator's hand 38. If the state is prior to the play of a hand or after the completion of the play of a hand, then depression of the deal/gin switch indicates that the computer hand is to be dealt at step 158, the player hand is to be dealt at step 160, and the game state is to be changed to mid-game at step 162. The program then changes the display at step 164 to indicate the player's hand and recirculates to step 110. If the game state is other than pre- or post-game, the program proceeds to step 166 at which a determination is made as to whether Go Draw is being played. If it is, depression of the deal/gin key 23 has no meaning; and the program proceeds to junction step 110 to determine which, if any, other switches have been depressed.

If the game is not Go Draw, the program proceeds to step 168 at which the flashing card is discarded. This branch will be taken if a player has depressed the deal/gin input switch 23 to indicate that he believes he has gin, if playing Gin Rummy, or thirty three points, if playing the game Thirty Three. The program then proceeds to step 170 to determine which of the two games is being played. If Gin Rummy is being played, the program proceeds to step 172 to decide whether the player has gin. If the comparator circuit 48 determines the player has gin by finding only completed runs and three or more cards of a kind, the program proceeds to step 174 to cause the message display 46 to indicate "Gin" and to increment the player's score at step 176. Completion of step 176 returns the program to junction step 110.. If the player does not have gin, the program proceeds to step 178 to output the message "No Gin" at the message display 46 and to increment the computer's score at step 180. The program then returns to junction step 110.

If it is determined at step 170 that Thirty Three is being played, the program proceeds to step 182 at which it is determined whether the operator has thirty three points by the comparator circuit 48 by totalling the points in the operator hand 38. If the operator has thirty three points, then the program proceeds to step 184 to display the output message "33" at the message display 46 and thence to step 186 to increment the operator's score. The program then returns to junction step 110. If the operator is determined not to have thirty three points by the comparator circuit 48, the program proceeds to step 188 to cause the message display 46 to indicate "No 33" and to step 190 to increment the computer's score. The program then returns to junction step 110.

FIG. 5(*d*) indicates the steps taken by the program when it is determined at step 114 that the draw input switch 20 has been depressed. The draw input key 20 is used to draw cards from the deck 40 in Gin Rummy and Thirty Three, to request cards in the computer hand 36 in Go Draw, and to tell the computer to go draw in Go Draw. When the draw switch 20 is closed, the program proceeds by way of junction 126 to step 192 where the state of the game is determined. If the game is in the condition prior to deal or after completion of the hand, the depression of the draw input switch 20 has no meaning; and the program recirculates to junction step 110. If the game is in mid-game state and it is the operator's turn, the program proceeds to step 194 to determine whether the game played is Go Draw. If it is not, the game recirculates to junction step 110. If the game being played is Go Draw, the program proceeds to step 196 where the determination is made as to whether the computer hand 36 has any cards of like value to the flashing card of the operator hand 38. If the computer hand 36 has no such cards, the program proceeds to step 198 where the output message "Go Draw" is displayed by the message display 46 and to step 200 to draw a card for the operator from the deck 40. The program then moves to step 204.

If the computer has a card of the requested value, the program proceeds from step 196 to step 202 to mark those cards in the computer game play control 44 as in the operator hand 38. The program then proceeds to step 204 where a determination is made as to whether the operator has four of a kind by the comparator circuit 48. If so, these cards are marked as four of a kind at step 206, the display is updated at step 208 by removing the cards from the operator hand 38, and the operator score is increased by one at step 209. The program then proceeds to step 210 to ask whether either hand is out of cards. Step 210 is also reached if it is found at step 204 that the operator does not have four of a kind of the cards drawn from the computer hand 36. In either case, if neither hand is out of cards, the program returns to junction step 110. If either hand is out of cards, the program moves to step 212 to end the game and thence to step 214 to change the display 18 to display the appropriate score. The program then recirculates to junction step 110.

If at step 192 it is determined it is neither post-game, pre-game, or the operator's turn, the program moves to step 216 at which a determination of the game being played is made. If Gin 1 or Gin 2 is being played, the closure of the draw key 20 has no meaning during play of the computer hand 36, and the program moves to step 218 to switch the game state to the operator's turn. The program then moves to step 220 to discard the flashing face up card and to step 222 to draw a card for the operator hand. Finally, the program recirculates to junction step 110.

If at step 216 the determination is made that the game being played is Thirty Three, the closure of the draw key 20 has no meaning during the computer turn so the program proceeds to step 224 to switch the game state to operator turn and to step 226 to discard the face up card. From step 226, the program proceeds to step 228 to draw two cards and then returns to junction step 110.

If the game being played at step 216 is Go Draw, then the draw key 20 is depressed to tell the computer the operator does not have the requested cards; and the program proceeds to step 230 at which the determination is made as to whether the operator in fact has any of the cards of the value of the requested card. If the player has such cards, then the closure of the draw key 20 is an error; and the program recirculates to junction step 110. If the operator has no such cards, a card is drawn at step 232 for the computer hand 38; and the program proceeds to step 234 to determine whether the computer hand 36 has four cards of a kind. If not, the program proceeds to switch the game state to the operator's turn at step 236 and to return to junction step 110. If a computer has four of a kind at step 234, the program proceeds to step 238 to mark the four cards and to update the computer score and the display 18 at step 240 by removing those cards from the play. The program next moves to step 242 to determine whether the computer hand 36 is out of cards. If not, the program moves to step 236 to switch the game state to the player's turn. If the computer hand 36 is out of cards, the program moves to step 244 to end the game and to step 246 to change the display to illustrate the score of the game. The program then returns to junction step 110.

FIG. 5(*e*) describes the operation of the program of the simulator 10 when it is determined at step 112 that the discard input switch 22 has been depressed. The discard key 22 is utilized to discard cards in Gin and Thirty Three to switch to computer turn in Go Draw, and to tell the computer to take cards from the operator hand in Go Draw. The program first proceeds via junction 124 to step 248 at which a determination of the game state is made. If the game is in a state before a hand has been dealt or after the hand has been completed, depression of the discard switch has no meaning and the program recirculates to junction step 110. If, on the other hand, it is mid-game and the computer's turn, the program proceeds to step 250 to determine whether the game played is Go Draw. If not, the switch closure has no meaning; and the program recirculates to junction step 110. If the game being played is Go Draw, depression of the discard switch indicates that the player has at least one card of the value requested by the computer, and the program moves to step 252 where this question is asked. If the player does not have such a card, the program recirculates to junction step 110 because the discard switch 22 has been depressed in error.

If the player has such a card, the program moves to step 254 to mark the cards in the computer hand and then to step 256 to determine if the computer has four of a kind. If the computer does not have four of a kind, it moves to step 258 to ask whether anyone is out of cards. If the computer does have four of a kind, the program moves to step 260 and marks the cards as a run and then to step 262 to increment the computer's score and to provide the appropriate display indication at the display 18. After step 262 the program moves to step 258. If no one is out of cards at step 258, the program moves to step 264 to switch the game state to the operator's turn and returns to junction step 110. If a player is out of cards at step 258, the program moves to step 266 to end the game and step 268 to change display 18 to exhibit the score. The program then moves to junction step 110.

If at step 248 it is determined that it is mid-game and the operator's turn, the program moves to step 270 to determine which game is being played. If Go Draw is being played, the depression of the discard key 22 is to switch the game to the computer's turn; and the program moves to step 272 to switch the game state to the computer's turn and then to step 274 to determine which of the computer's cards the computer will ask the player for under control of computer game play control 44. When the card to be requested has been determined as explained above, the program moves to step 276 to mark the requested card as flashing and returns to junction step 110.

If the game being played at step 270 is Thirty Three, the computer program advances to step 278 to switch the game state to the computer's turn and then to step 280 to determine whether the player's discard gives the computer thirty three points. As indicated above, this is accomplished by adding the value of all cards in the computer hand 36 to the value of the discard and subtracting thirty three therefrom. If the remainder is identical to a card in the computer hand 36, that card is discarded and thirty three points is obtained. In this case, the program moves to step 282 to output the message "Thanks" and then to step 284 to discard the remainder-valued card to leave thirty three points remaining in the computer hand 36. From step 284, the program proceeds through stage 286 to indicate the output message "33" at the message display 46, 288 to increment the computer score, and 290 to end the game. The program then returns to junction step 110.

If at step 280 the operator's discard does not give the computer an exact thirty three points, the program proceeds to step 292 to ask whether the sum of all cards including the face up discard is greater than thirty three. If not, the program proceeds to step 294 to display the message "No Thanks" at the message display 46. From step 294, the program proceeds to step 296 to draw two cards for the computer hand 36 and to step 298 to determine whether these cards give the computer thirty three points. This determination is made as explained above, and a "yes" indication routes the program to step 284 from which it proceeds as previously explained. A "yes" indication at step 292 as to whether the sum of all cards including the face up discard is greater than thirty three moves the program to step 300 to output the message "Thanks" at the message display 46. The program then moves to step 302 to determine a suitable discard as explained above with respect to FIG. 3. From step 302, the program moves to mark the discarded card at step 304 and to return to junction step 110. As may be seen in FIG. 5(*e*) the program also proceeds to step 302 to find a suitable discard if at step 298 it determines that the two cards drawn do not give the computer an exact thirty three points.

If at step 270 of the program, the game being played is found to be Gin Rummy, the program moves to step 310 to switch the state of the game to the turn of the computer opponent. The program then moves to step 312 to ask whether the operator's discard gives the computer hand 36 gin. This is accomplished by including the operator's discard in the computer hand 36 and determining whether gin exists if any of the other cards in the computer hand 36 is discarded. In this manner, the computer hand 36 may arrive at a gin hand in a manner other than by re-drawing the cards from its original perfect hand which were discarded and held in memory by the computer play control 44. An example of such a situation would be one in which the original hand included an ace, two, three, and four of clubs, three fives, and three tens; and had discarded one five, one then, and the four of clubs. Presuming that the five and ten had been picked up during the play of the hand and the computer hand 36 was waiting for the four of clubs, if either a five or a ten appeared in the discard these would be checked for, and would give, gin for the computer hand 36 even though the four of clubs had not yet been recovered.

If the computer hand does have gin at step 312, the program next moves to step 314 to cause the display 18 to display the output message "Thanks" and to step 316 to display the message "Gin!*" The computer's score is then incremented by one at step 318, and the game state is changed to "end of the game" at step 320.

If at step 312 the operator's discard does not give the computer gin, the program moves to step 322 to determine whether the card is desirable to the computer hand 36. A card is desirable if it is one of the cards held in the original perfect gin hand but discarded and held in memory. If such a card appears, the output message "Thanks" is displayed by the display 18 at step 324, and the computer moves to step 326 to find an undesirable card to discard (i.e., a card not in the original perfect hand) and to step 328 to discard this undesirable card.

If the operator's discard is undesirable to the computer at step 322, the program moves to step 330 to cause the display 18 to flash the message "No Thanks" and proceeds to draw a card at step 332. This card is included in the computer hand and checked to determine whether it gives the computer gin at step 334. The determination is made in the same manner as is the determination at step 312 by discarding each of the other cards held in the computer hand 36, one at a time, and seeing if the remaining cards gives gin. If the drawn card gives gin, the computer program moves to step 316 to output the message"Gin!*", increment the computer score, and change the game state to "end of the game." If this card does not give the computer gin, the program moves to step 326 to find an undesirable card to discard and to step 328 to mark that card.

As will be understood by those skilled in the art, many different programs may be utilized to implement the flow chart disclosed in FIGS. 5(*a*)–5(*e*). Obviously, these programs will vary from one another in some degree. However, it is well within the skill of the art of the computer programmer to provide particular programs for implementing each of the steps of the flow chart disclosed herein. It is also to be understood that various microcomputer circuits other than that selected for the preferred embodiment might be used without departing from the teaching of the invention. It is therefore to be understood that, because various other embodiments may be devised by those skilled in the art without departing from the spirit and scope of the invention, it is the intention of the inventors to be limited only by the scope of the claims appended thereto.

What is claimed is:

1. A device for simulating the play of Gin Rummy comprising a housing; a display including indicia representing the cards in a single deck of cards; a plurality of input switches by which an operator may indicate the play of a card game; and an electronic data processor operated in response to the input switches and including means for simulating the play of a hand of Gin Rummy in opposition to the play of the operator, and means for causing the display to present a simulated game, including means for using the indicia to display the operator's hand and the hand being played in opposition to the play of the operator.

2. A device as in claim 1 in which the means for causing the display to present the simulated game is operated to cause the display to present cards of a hand dealt to an operator, to present a flashing face-up card, and to add cards to and discard cards from the operator's hand.

3. A device as in claim 2 in which the means for causing the display to present the simulated game further includes indicia to indicate either the acceptance or the rejection of the operator's discard, in opposition to the play of the operator.

4. A device as in claim 2 in which the means for causing the display to present the simulated game further includes indicia to indicate either the acceptance or the rejection of a card drawn from the deck in opposition to the play of the operator.

5. A device as in claim 1 in which the data processor further comprises means for simulating the play of a hand of Thirty Three in opposition to the play of the operator.

6. A device as in claim 1 in which the data processor further comprises means for simulating the play of a hand of Go Draw in opposition to the play of the operator.

7. A device as in claim 1 in which the data processor further comprises means for simulating the play of a hand of Thirty Three and a hand of Go Draw, both in opposition to the operator.

8. An electronic data processor for simulating the play of Gin Rummy in opposition to an operator comprising means for dealing a perfect Gin Rummy hand, means for discarding cards from the perfect Gin Rummy hand and selecting new cards to fill the hand, and means for retrieving the cards previously discarded as play of the game progresses.

9. An electronic data processor as in claim 8 further comprising means for checking the hand as the game progresses to determine whether the cards held therein constitute a perfect Gin Rummy hand.

10. An electronic data processor as in claim 8 further comprising means for dealing a hand at random to the operator; means for allowing the operator to draw and discard cards, and means for reviewing the operator's hand to determine whether Gin Rummy exists.

11. An electronic data processor as in claim 8 in which the skill level of the game is varied by varying the number of cards discarded from the perfect Gin Rummy hand, a greater number of cards discarded producing a lower skill level of the game.

12. An electronic data processor for simulating a game of cards in opposition to an operator comprising means for simulating a deck of cards, means for dealing hands of two cards each at random to the operator and to the data processor, display means including indicia representing the cards in a single deck of cards, means for using the indicia for displaying the operator's hand, for displaying a face up card in the operator's hand, and for displaying a hand being played in opposition to the play of the operator, means for allowing the data processor and the operator to select cards from the deck and to discard the face up card, and means for determining whether either hand is a winning hand.

13. An electronic data processor as claimed in claim 12 wherein the means for determining whether either hand is a winning hand comprises a circuit for counting the points in each of the hands.

14. An electronic data processor for simulating the play of a card game in opposition to an operator comprising means for simulating a deck of cards, means for dealing a hand of cards selected randomly to each of the players, means for one each of the players to select a card from its hand and for requesting cards of like value from the other players' hands, means for providing a card from the deck if no requested card is present in the hand from which it is requested, means for scoring each four of a kind in a hand, means for determining when a hand is out of cards, and display means including indicia representing the cards in a single deck of cards, and means for using the indicia to display the operator's hand and the hand being played in opposition to the play of the operator.

15. The apparatus of claims 1, 12, or 14 in which the indicia is further used to display the score of the game.

16. An electronic data processor as in claim 14 in which the display means further includes indicia to indicate that none of the requested cards are present in the hand from which they are requested.

* * * * *